US012520987B2

(12) United States Patent
Durham et al.

(10) Patent No.: US 12,520,987 B2
(45) Date of Patent: Jan. 13, 2026

(54) DRAIN PUMP ASSEMBLY FOR A DISHWASHER APPLIANCE

(71) Applicant: Haier US Appliance Solutions, Inc., Wilmington, DE (US)

(72) Inventors: Kyle Edward Durham, Louisville, KY (US); Benjamin David Thomas, Toledo, OH (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 40 days.

(21) Appl. No.: 18/431,085

(22) Filed: Feb. 2, 2024

(65) Prior Publication Data

US 2025/0248581 A1 Aug. 7, 2025

(51) Int. Cl.
*A47L 15/42* (2006.01)

(52) U.S. Cl.
CPC ..... *A47L 15/4225* (2013.01); *A47L 15/4206* (2013.01); *A47L 15/4219* (2013.01)

(58) Field of Classification Search
CPC ..... A47L 15/4225; A47L 15/4206; A47L 15/4219
See application file for complete search history.

(56) References Cited

U.S. PATENT DOCUMENTS 2,934,023 A * 4/1960 Lamkin ..... F04D 7/04 415/206
3,209,094 A * 9/1965 Bauer ..... H01H 35/34 200/83 WM
3,510,229 A 5/1970 Smith
4,923,366 A * 5/1990 Kern ..... D06F 39/085 415/107
5,092,141 A * 3/1992 Quinn ..... D06F 39/022 68/17 R
5,566,696 A * 10/1996 Dries ..... A47L 15/4202 277/420
10,258,217 B2 4/2019 Dries
10,718,081 B2 * 7/2020 Choi ..... D06F 39/085
(Continued)

FOREIGN PATENT DOCUMENTS

BR PI0904372 A2 * 6/2011
CA 2032234 A1 * 6/1991
CN 110873063 A 3/2020
(Continued)

OTHER PUBLICATIONS

Machine Translation of JP 2005146959 A to Manda et al. (Jun. 2005). (Year: 2005).*

*Primary Examiner* — Benjamin L Osterhout
(74) *Attorney, Agent, or Firm* — Dority & Manning, P.A.

(57) ABSTRACT

A fluid circulation assembly defining a vertical direction includes a drive shaft defining an axial direction, a radial direction, and a circumferential direction, a motor operable to rotate the drive shaft in a first direction and in a second direction opposite the first direction, and a drain pump assembly. The drain pump assembly includes a hub assembly mounted to the drive shaft and a plurality of rigid vanes, each of the plurality of rigid vanes being rotatably mounted to the hub assembly at a pivot point and extending to a distal end and being movable between an extended position when the motor is rotating in the first direction and a retracted position when the motor is rotating in the second direction.

20 Claims, 9 Drawing Sheets

(56) References Cited

U.S. PATENT DOCUMENTS

| | | | |
|---|---|---|---|
| 2015/0136188 | A1 | 5/2015 | Xu |
| 2018/0325348 | A1 | 11/2018 | Dries |

FOREIGN PATENT DOCUMENTS

| | | | | | |
|---|---|---|---|---|---|
| CN | 111134584 | A | * | 5/2020 | ..... A47L 15/42 |
| CN | 212382590 | U | * | 1/2021 | |
| DE | 102008054766 | A1 | * | 6/2010 | ..... F04D 29/247 |
| DE | 102009047446 | A1 | * | 6/2011 | ..... F04D 7/04 |
| EP | 0166104 | B1 | | 9/1989 | |
| JP | 2005146959 | A | | 6/2005 | |

* cited by examiner

DRAIN PUMP ASSEMBLY FOR A DISHWASHER APPLIANCE

FIELD OF THE INVENTION

The present disclosure relates generally to dishwasher appliances, and more particularly to an improved drain pump assembly for dishwasher appliances.

BACKGROUND OF THE INVENTION

Dishwasher appliances generally include a tub that defines a wash chamber. Rack assemblies can be mounted within the wash chamber of the tub for receipt of articles for washing. Wash fluid (e.g., various combinations of water and detergent along with optional additives) may be introduced into the tub where it collects in a sump space at the bottom of the wash chamber. During wash and rinse cycles, a pump may be used to circulate wash fluid to spray assemblies within the wash chamber that can apply or direct wash fluid towards articles disposed within the rack assemblies in order to clean such articles. During a drain cycle, a pump may periodically discharge soiled wash fluid that collects in the sump space and the process may be repeated.

Conventional dishwasher appliances use two separate motors to operate a wash pump and a drain pump. However, additional motors take up more space, add cost, and require additional seals, thus increasing the likelihood of leaks and decreasing appliance reliability. Certain dishwasher appliances have eliminated the need for a second motor by using a single motor and a common drive shaft to rotate a wash pump impeller and a drain pump impeller. In this regard, the wash pump impeller and the drain pump impeller may be separated by a filter, and the motor may rotate in one direction to circulate wash fluid (i.e., the "wash direction") and the other to drain wash fluid (i.e., the "drain direction").

However, because impellers have the tendency to pump fluid even when rotated in the reverse direction (albeit less efficiently), the drain pump impeller may discharge water from the sump even when the motor is rotating in the wash direction. Certain dishwasher appliances have attempted to prevent this issue using complicated valve systems or one-way clutches, but these solutions may be expensive and/or increase the load on the motor.

Accordingly, a dishwasher appliance that utilizes a single motor and common drive shaft to rotate a wash pump and a drain pump would be useful. More specifically, a drain pump assembly that does not pump fluid when the common drive shaft is rotated in the wash direction would be particularly beneficial.

BRIEF DESCRIPTION OF THE INVENTION

Advantages of the invention will be set forth in part in the following description, or may be apparent from the description, or may be learned through practice of the invention.

In one exemplary embodiment, a fluid circulation assembly is provided including a drive shaft defining an axial direction, a radial direction, and a circumferential direction, a motor operable to rotate the drive shaft in a first direction and in a second direction opposite the first direction, and a drain pump assembly. The drain pump assembly includes a hub assembly mounted to the drive shaft and a rigid vane rotatably mounted to the hub assembly at a pivot point and extending to a distal end, the rigid vane being movable between an extended position when the motor is rotating in the first direction and a retracted position when the motor is rotating in the second direction.

In another exemplary embodiment, a dishwasher appliance is provided including a wash tub that defines a wash chamber, a wash rack mounted within the wash chamber, the wash rack being configured for receiving articles for washing, and a fluid circulation assembly for providing a flow of wash fluid for cleaning articles placed within the wash chamber. The fluid circulation assembly includes a drive shaft defining an axial direction, a radial direction, and a circumferential direction, a motor operable to rotate the drive shaft in a first direction and in a second direction opposite the first direction, a hub mounted to the drive shaft, a hub assembly mounted to the drive shaft, and a rigid vane rotatably mounted to the hub assembly at a pivot point and extending to a distal end, the rigid vane being movable between an extended position when the motor is rotating in the first direction and a retracted position when the motor is rotating in the second direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
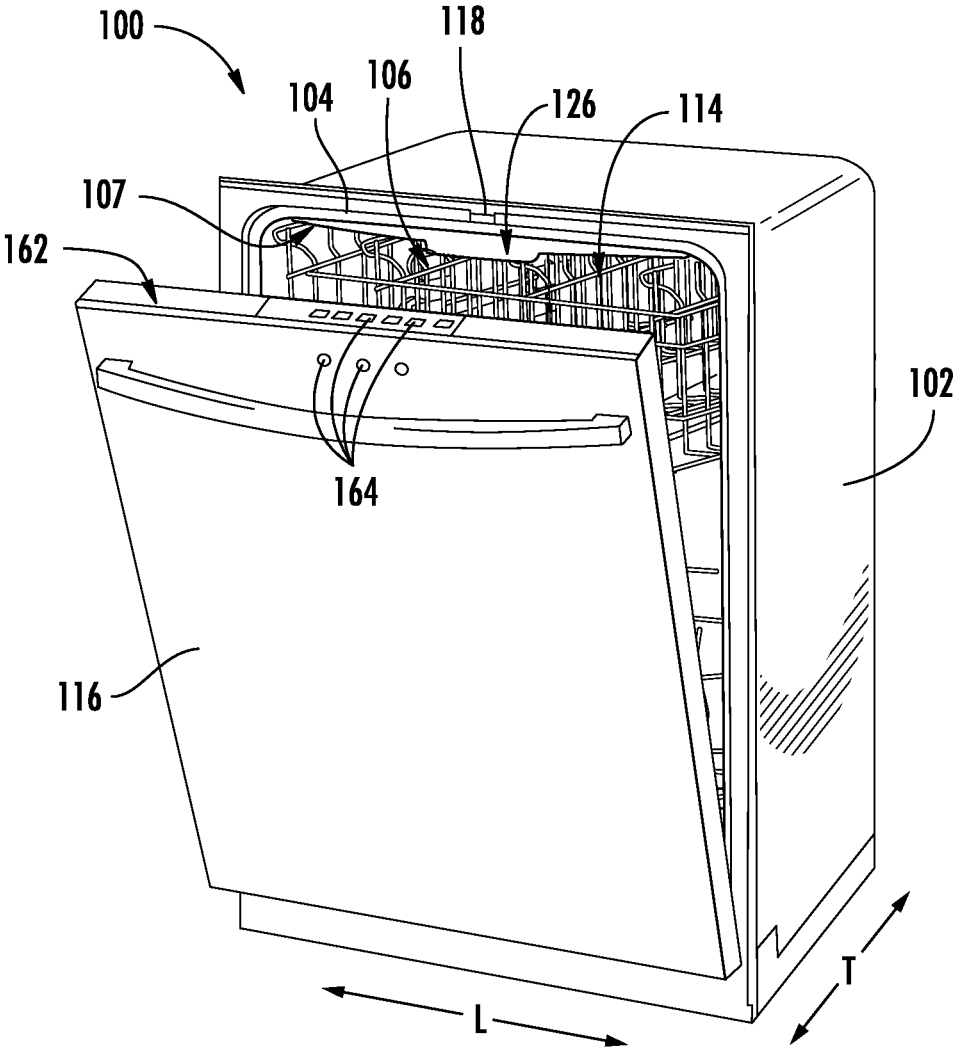
FIG. 1 provides a perspective view of an exemplary embodiment of a dishwashing appliance of the present disclosure with a door in a partially open position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
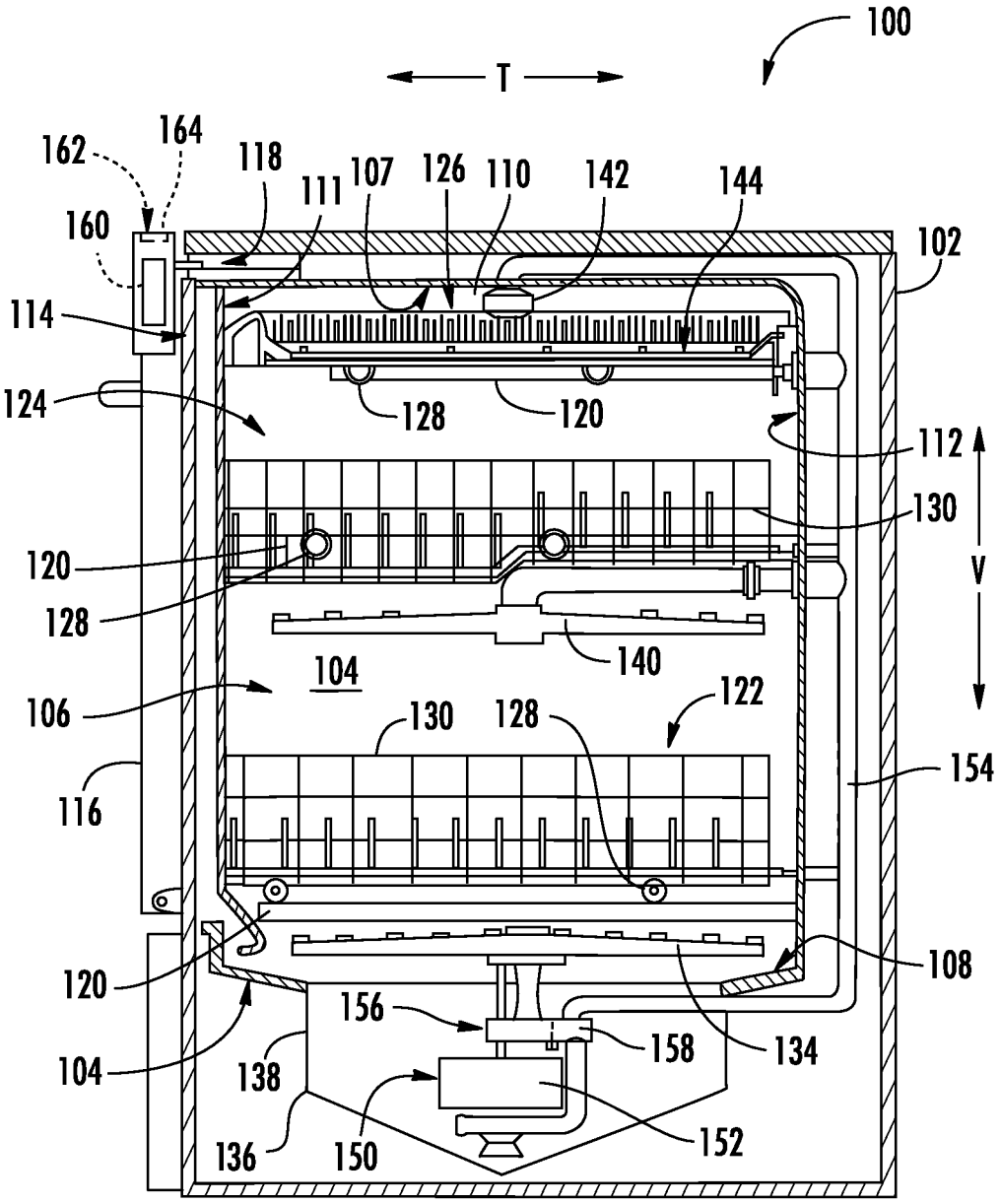
FIG. 2 provides a side, cross-sectional view of the exemplary dishwashing appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 (FIG. 2) having a tub 104 therein that defines a wash chamber 106. As shown in FIG. 2, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually perpendicular to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As best illustrated in FIG. 2, tub side walls 110 accommodate a plurality of rack assemblies. More specifically, guide rails 120 may be mounted to side walls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles, e.g., during a cleaning or rinsing cycle. According to another exemplary embodiment, a silverware basket (not shown) may be removably attached to a rack assembly, e.g., lower rack assembly 122, for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region of wash chamber 106. Specifically, dishwasher 100 may include a sump housing 136 that is positioned at a bottom of tub 104, the sump housing 136 defining a sump space (referred to herein generally as a sump 138). According to example embodiments, lower spray arm assembly 134 is positioned in the lower region of wash chamber 106, e.g., just above sump 138, to rotate in relatively close proximity to lower rack assembly 122.

Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging and/or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water and wash fluid (e.g., detergent, water, and/or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water and/or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies, e.g., to mid-level spray arm assembly 140 and upper spray assembly 142. However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only, and are not limitations of the present subject matter.

In operation, pump 152 draws wash fluid in from sump 138 and pumps it to a diverter assembly 156, e.g., which is positioned within sump 138 of dishwasher appliance. Diverter assembly 156 may include a diverter disk (not shown) disposed within a diverter chamber 158 for selectively distributing the wash fluid to the spray arm assemblies 134, 140, 142 and/or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134, a second conduit for rotating mid-level spray arm assembly 140, a third conduit for spraying upper spray assembly 142, and a fourth conduit for supplying a filter cleaning assembly or other subsystem, which will be described in more detail below according to an exemplary embodiment.

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter.

Figure 3:
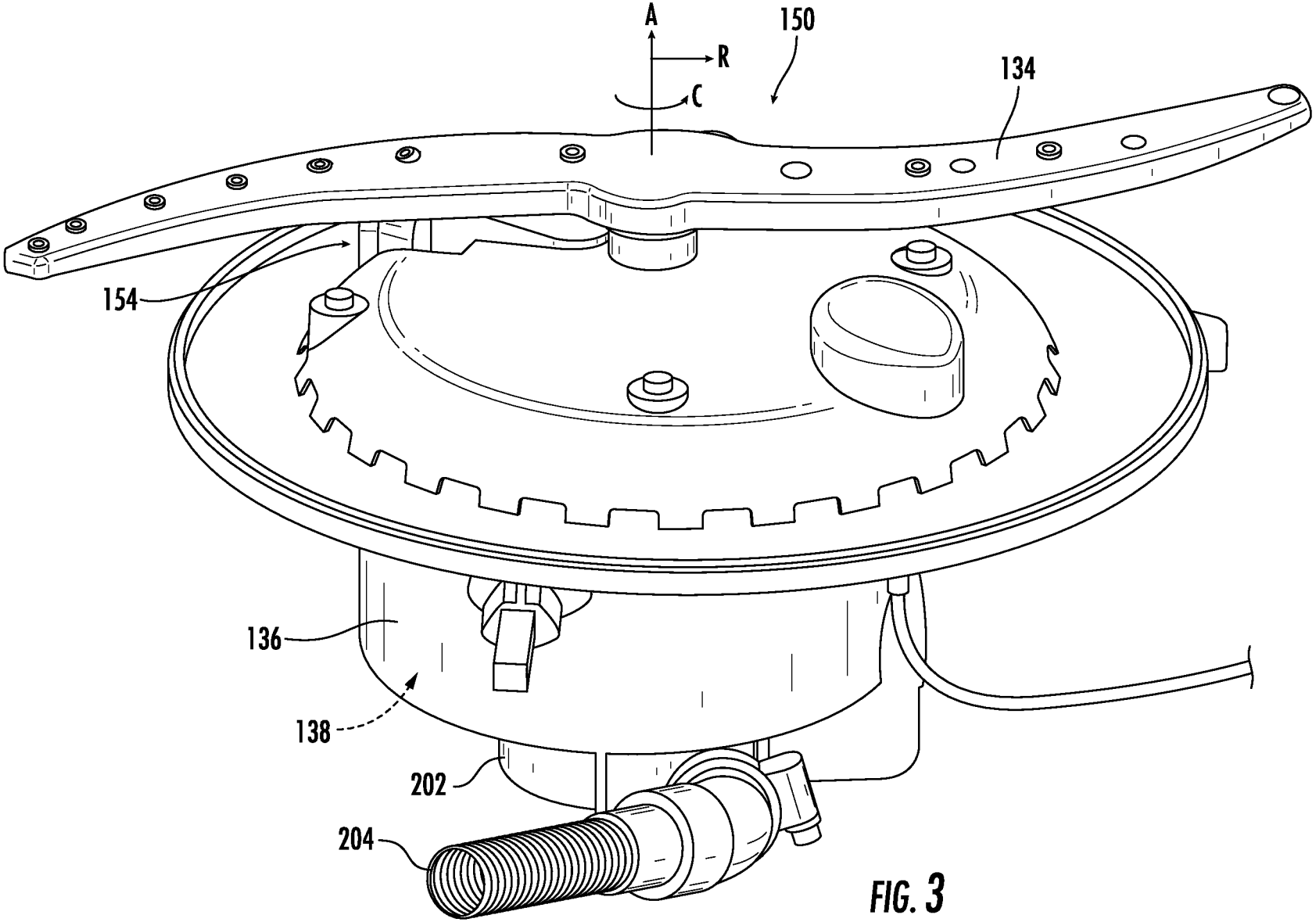
FIG. 3 provides a perspective view of certain components of a fluid circulation assembly according to an example embodiment of the present subject matter.
Figure 4:
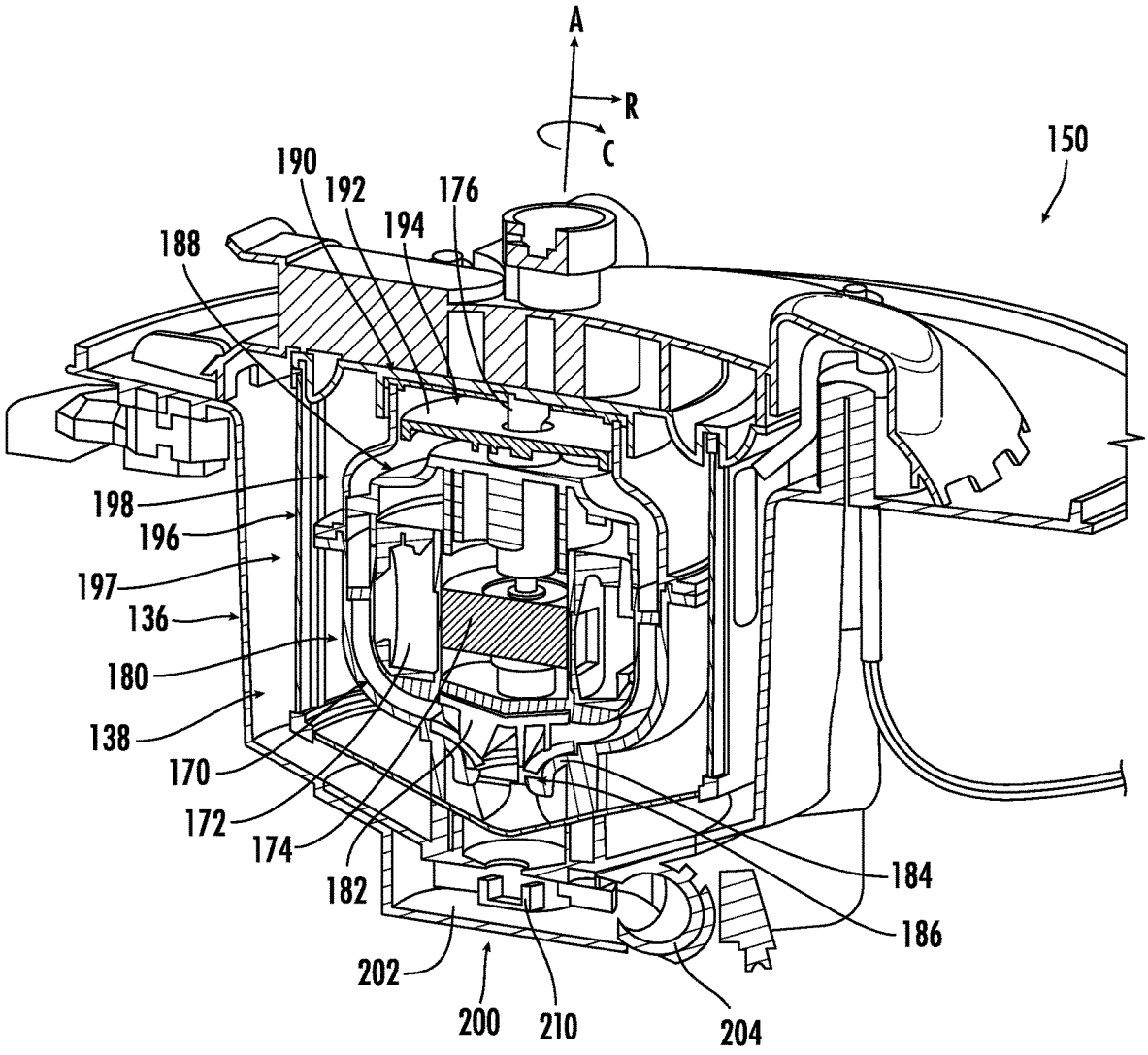
FIG. 4 provides a perspective, cross-sectional view of the exemplary fluid circulation assembly of FIG. 3 according to an example embodiment of the present subject matter.
Figure 5:
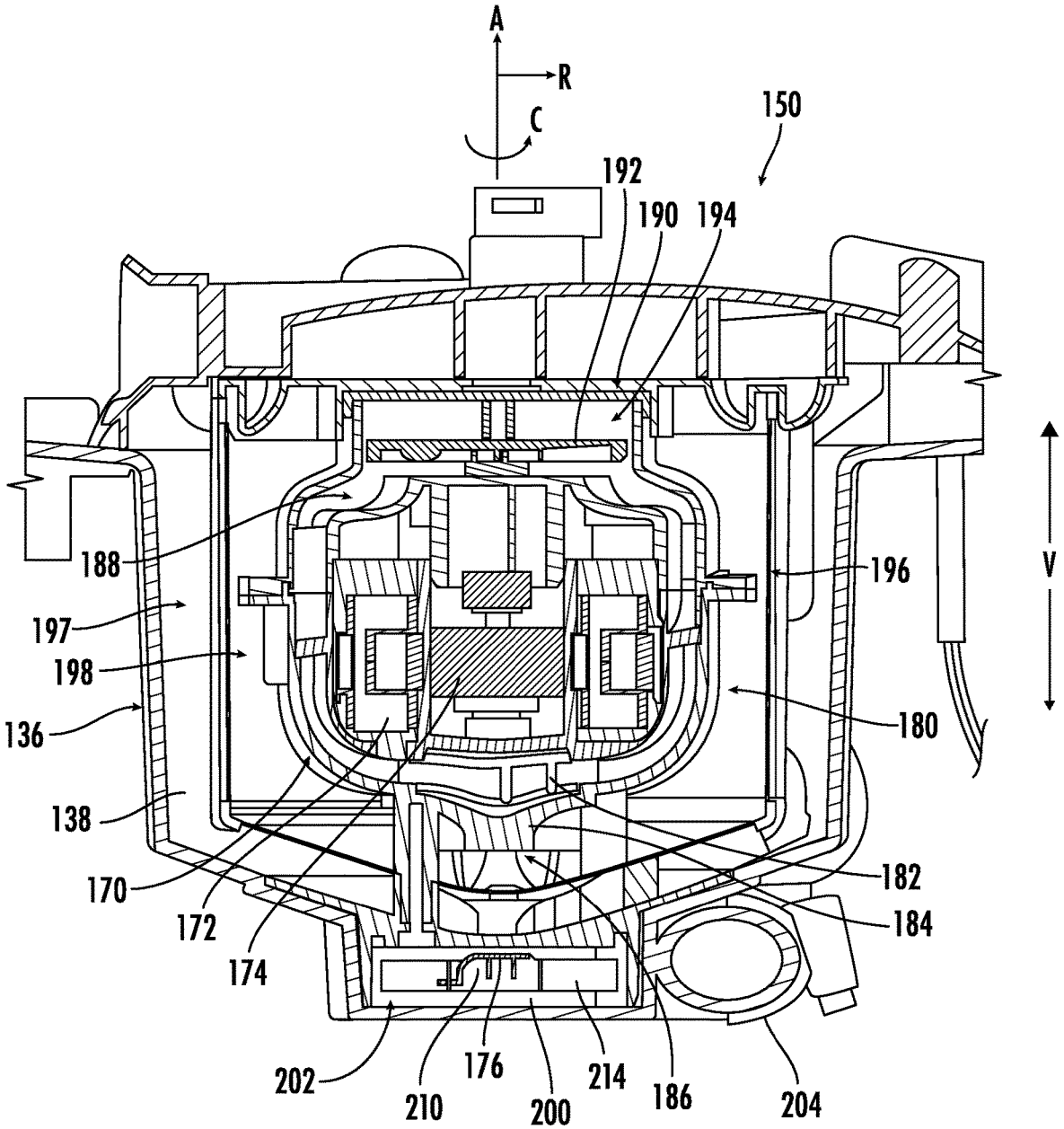
FIG. 5 provides a side, cross-sectional view of the exemplary fluid circulation assembly of FIG. 3 according to an example embodiment of the present subject matter.
Figure 6:
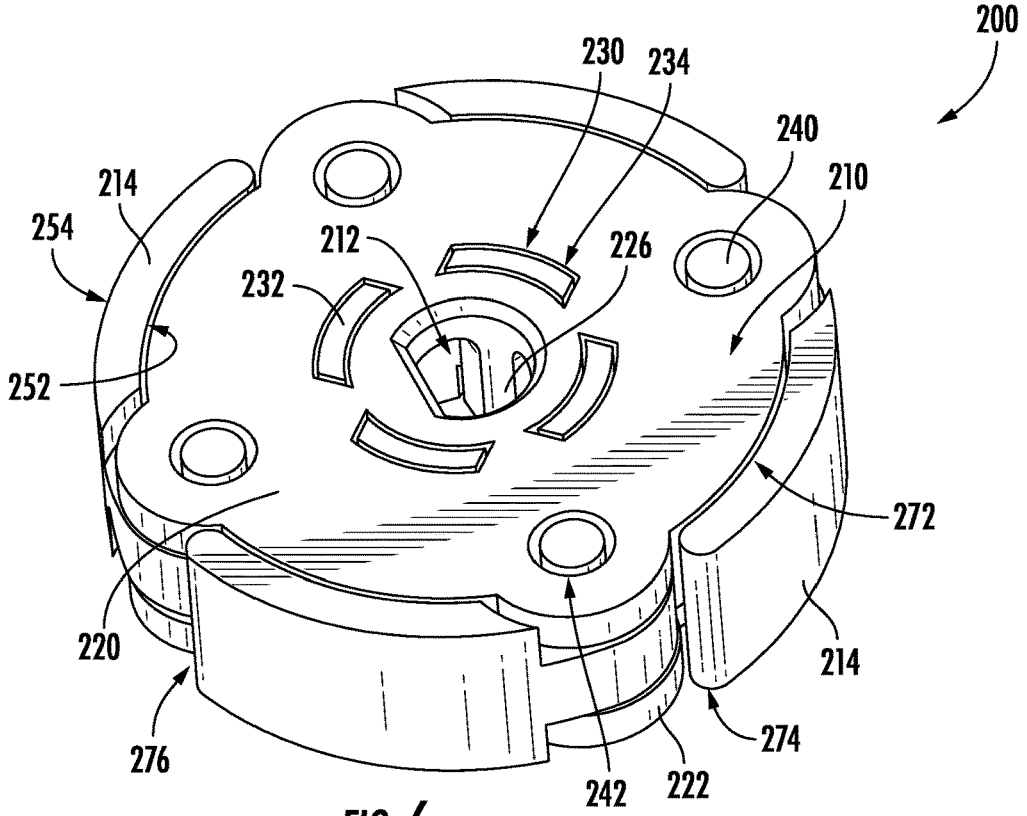
FIG. 6 provides a perspective view of a drain pump impeller that may be used with the example fluid circulation assembly of FIG. 3, where the drain pump impeller is in a retracted position according to an example embodiment of the present subject matter.

Referring now generally to FIGS. 3 through 5, fluid circulation assembly 150 will be described according to an example embodiment of the present subject matter. Fluid circulation assembly 150 may include a drive motor 170 that may be disposed within sump 138 of tub 104 and may be configured to rotate multiple components of dishwasher 100. As illustrated, drive motor 170 may be, for example, a brushless DC motor having a stator 172, a rotor 174, and a drive shaft 176 attached to rotor 174. A controller or control board (not shown) may control the speed of motor 170 and rotation of drive shaft 176 by selectively applying electric current to stator 172 to cause rotor 174 and drive shaft 176 to rotate. Although drive motor 170 is illustrated herein as a brushless DC motor, it should be appreciated that any suitable motor may be used while remaining within the scope of the present subject matter. For example, according to alternative embodiments, drive motor 170 may instead be a synchronous permanent magnet motor.

According to an example embodiment, drive motor 170 may be a variable speed motor. In this regard, drive motor 170 may be operated at various speeds depending on the current operating cycle of the dishwasher. For example, according to an exemplary embodiment, drive motor 170 may be configured to operate at any speed between a minimum speed, e.g., 1500 revolutions per minute (RPM), to a maximum rated speed, e.g., 4500 RPM. In this manner, use of a variable speed drive motor 170 enables efficient operation of dishwasher 100 in any operating mode. Thus, for example, the drain cycle may require a lower rotational speed than a wash cycle and/or rinse cycle. A variable speed drive motor 170 allows impeller rotation at the desired speeds while minimizing energy usage and unnecessary noise when drive motor 170 does not need to operate at full speed.

According to an exemplary embodiment, drive motor 170 and all its components may be potted. In this manner, drive motor 170 may be shock-resistant, submersible, and generally more reliable. Notably, because drive motor 170 is mounted inside wash chamber 106 and is completely submersible, no seals are required and the likelihood of leaks is reduced. In addition, because drive motor 170 is mounted in the normally unused space between lower spray arm assembly 134 and a bottom wall of sump 138, instead of beneath the sump 138, this design is inherently more compact than conventional designs.

According to an exemplary embodiment, fluid circulation assembly 150 may be vertically mounted within sump 138 of wash chamber 106. More particularly, drive motor 170 of fluid circulation assembly 150 may be mounted such that drive shaft 176 is oriented along vertical direction V of dishwasher 100. More particularly, drive shaft 176 may define an axial direction A, a radial direction R, and a circumferential direction C (FIG. 3), with the axial direction A being parallel to the vertical direction V of the dishwasher 100. As illustrated in FIG. 4, drive shaft 176 is rotatably supported by upper and lower bearings and extends out of a bottom of drive motor 170 toward a bottom of sump 138. However, it should be appreciated that according to alternative embodiments, fluid circulation assembly 150 may be mounted such that drive shaft 176 is oriented in any other suitable direction, e.g., such as along a horizontal direction.

As illustrated, drive shaft 176 is configured for driving a circulation or wash pump assembly 180. Wash pump assembly 180 may generally be configured for circulating wash fluid within wash chamber 106 during wash and/or rinse cycles. More specifically, wash pump assembly 180 may include a wash pump impeller 182 disposed on drive shaft 176 within a pump housing 184. Pump housing 184 defines a pump intake 186 for drawing wash fluid into wash pump impeller 182. According to the illustrated embodiment, pump intake 186 is facing downward along the vertical direction V and is located very near the bottom of sump 138. In this manner, the amount of water required to prime and operate wash pump assembly 180 is minimized. This is particularly advantageous when running low water cycles for the purpose of water and energy savings.

As shown in FIG. 4, pump housing 184 is in fluid communication with a supply conduit 188 through which pressurized wash fluid may be recirculated through fluid circulation assembly 150. More specifically, according to the illustrated embodiment, wash pump impeller 182 draws wash fluid in from sump 138 and pumps it through supply conduit 188 to a diverter assembly 190 (such as diverter assembly 156) which generally distributes the flow of wash fluid as desired within dishwasher 100.

As shown in FIG. 4, diverter assembly 190 may include a diverter disc 192 disposed within a diverter chamber 194 (such as diverter chamber 158). Diverter chamber 194 is fluidly coupled to supply conduit 188, such that rotating diverter disc 192 may selectively distribute the flow of wash fluid to the spray arm assemblies 134, 140, 142, or any other fluid conduit coupled to diverter chamber 194. More particularly, diverter disc 192 may be rotatably mounted about the vertical direction V. Diverter disc 192 may have a plurality of apertures that are configured to align with one or more outlet ports at the top of diverter chamber 194. In this manner, diverter disc 192 may be selectively rotated to provide wash fluid to spray arm assemblies 134, 140, 142.

As illustrated, fluid circulation assembly 150 further includes a filter screen or filter 196. In general, filter 196 may define an unfiltered region 197 and a filtered region 198 within sump 138. During a wash or rinse cycle, wash fluid sprayed on dishes or other articles within wash chamber 106 falls into the unfiltered region 197. Wash fluid passes through filter 196 which removes food particles, resulting in relatively clean wash fluid within the filtered region 198. As used herein, "food particles" refers to food soil, particles, sediment, or other contaminants in the wash fluid which are not intended to travel through filter 196. Thus, a food particle seal may allow water or other wash fluids to pass from the unfiltered region 197 to the filtered region 198 while preventing food particles entrained within that wash fluid from passing along with the wash fluid.

As illustrated, filter 196 is a cylindrical and conical fine mesh filter constructed from a perforated stainless steel plate. Filter 196 may include a plurality of perforated holes, e.g., approximately 15/1000 of an inch in diameter, such that wash fluid may pass through filter 196, but food particles entrained in the wash fluid do not pass through filter 196. However, according to alternative embodiments, filter 196 may be any structure suitable for filtering food particles from wash fluid passing through filter 196. For example, filter 196 may be constructed from any suitably rigid material, may be formed into any suitable shape, and may include apertures of any suitable size for capturing particulates.

According to the illustrated exemplary embodiment, filter 196 defines an aperture through which drive shaft 176 extends. Wash pump impeller 182 is coupled to drive shaft 176 above filter 196 and a drain pump assembly (e.g., as described below) is coupled to drive shaft 176 below filter 196 along the vertical direction V. Fluid circulation assembly 150 may further include an inlet guide assembly (not labeled) which is configured for accurately locating and securing filter 196 while allowing drive shaft 176 to pass through aperture and minimizing leaks between the filtered and unfiltered regions 197, 198 of sump 138. More specifically, as best illustrated in FIG. 4, drive shaft 176 passes through a clearance bore in inlet guide assembly and through filter 196 between unfiltered region 197 and filtered region 198 of sump 138. Because the clearance bore has a diameter that is larger than the diameter of drive shaft 176, inlet guide assembly may further include a washer disposed within a chamber, e.g., in order to accommodate minor drive shaft wobble or misalignment while retaining a particle tight seal.

Referring now generally to FIGS. 3 through 5, a drain pump assembly 200 according to an exemplary embodiment of the present subject matter will be described. Drain pump assembly 200 may generally be configured for periodically discharging soiled wash fluid from dishwasher 100. Although illustrated and described as part of fluid circulation assembly 150, it should be appreciated that aspects of drain pump assembly 200 may be used in any impeller assembly in any application where it is desirable to selectively pump a fluid. In this regard, drain pump assembly 200 is only one exemplary configuration used for the purpose of explaining aspects of the present subject matter and is not intended to limit the scope of the invention in any manner.

Referring to FIG. 4, drain pump assembly 200 is coupled to drive shaft 176 and is positioned within a drain pump volute 202 below filter 196. Drain pump volute 202 is positioned at the very bottom of sump 138, such that wash fluid collects within drain pump volute 202. During a drain cycle, drain pump assembly 200 is rotated and soiled wash fluid is discharged from dishwasher 100 through a discharge conduit 204. After some or all of the soiled wash fluid is discharged, fresh water and/or wash additives may be added and the wash or rinse cycle may be repeated.

Referring now also to FIGS. 6 through 13, drain pump assembly 200 generally includes a hub assembly 210 that is mounted to drive shaft 176. Hub assembly 210 has a keyed bore 212 that is configured for receiving a bottom end of drive shaft 176. In an embodiment, drive shaft 176 and hub assembly 210 may be keyed so as to be in cooperative engagement. In this regard, for example, drive shaft 176 may by D-shaped (as shown) or may include one or more features, such as protrusions (not shown), in cooperative engagement with one or more features, such as recesses (not shown), in hub assembly 210, or vice versa. In addition, one or more pins, retaining clips, or other mechanical retention devices may be used to fix hub assembly 210 to drive shaft 176.

According to the illustrated exemplary embodiment, one or more vanes 214 are rotatably coupled to hub assembly 210. More specifically, according to the illustrated embodiments, drain pump assembly 200 includes four vanes 214, each vane 214 being positioned equidistantly around a circumference of hub assembly 210. In this regard, for example, one vane 214 is positioned in each quadrant of hub assembly 210 when viewed along the axial direction A, such that each vane 214 is separated by ninety degrees. In addition, according to the illustrated embodiment, each vane 214 is a single, rigid structure pivotally mounted to hub assembly 210.

As illustrated in the figures, each vane 214 may be mounted within and rotatably coupled to hub assembly 210. In this regard, hub assembly 210 may generally include a top portion 220 and a bottom portion 222 that are joined together to sandwich each vane 214 therebetween. According to the illustrated embodiment, hub assembly 210 may define a snap geometry 224 that is designed to secure top portion 220 and bottom portion 222 together. More specifically, according to the illustrated embodiment, snap geometry 224 may include resilient arms 226 that include a distal protrusion or snap geometry that is secured by a shoulder 228 defined in bottom portion 222 when top portion 220 and bottom portion 222 are properly aligned and pressed together.

In addition, hub assembly 210 may define an alignment geometry 230 that ensures top portion 220 and bottom portion 222 may be coupled (e.g., via snap geometry 224) only when top portion 220 and bottom portion 222 have the proper angular alignment. In this regard, bottom portion 222 may define one or more axial extensions 232 that are received within corresponding axial slots 234 defined on top portion 220. As illustrated, axial extensions 232 may prevent snap geometry 224 from fully engaging unless axial extensions 232 are aligned with and pass through axial slots 234. Although example snap geometries 224 and alignment geometries 230 are illustrated and described herein, it should be appreciated that variations and modifications may be made while remaining within the scope of the present subject matter.

According to the illustrated embodiment, hub assembly 210 may further define a plurality of mounting pins 240 that pass through a pivot point 242 of each rigid vane 214 to secure rigid vane 214 to hub assembly 210. In addition, mounting pins 240 may be designed to prevent reverse installation of rigid vanes 214. In this regard, each mounting pin 240 may define a shoulder geometry 244 and rigid vanes 214 may define complimentary voids 246 passing through pivot point 242 which is complementary to shoulder geometry 244. In this regard, mounting a rigid vane 214 upside down would prevent that vane 214 from seating properly on mounting pin 214 such that top portion 220 cannot seat properly on bottom portion 222.

Figure 7:
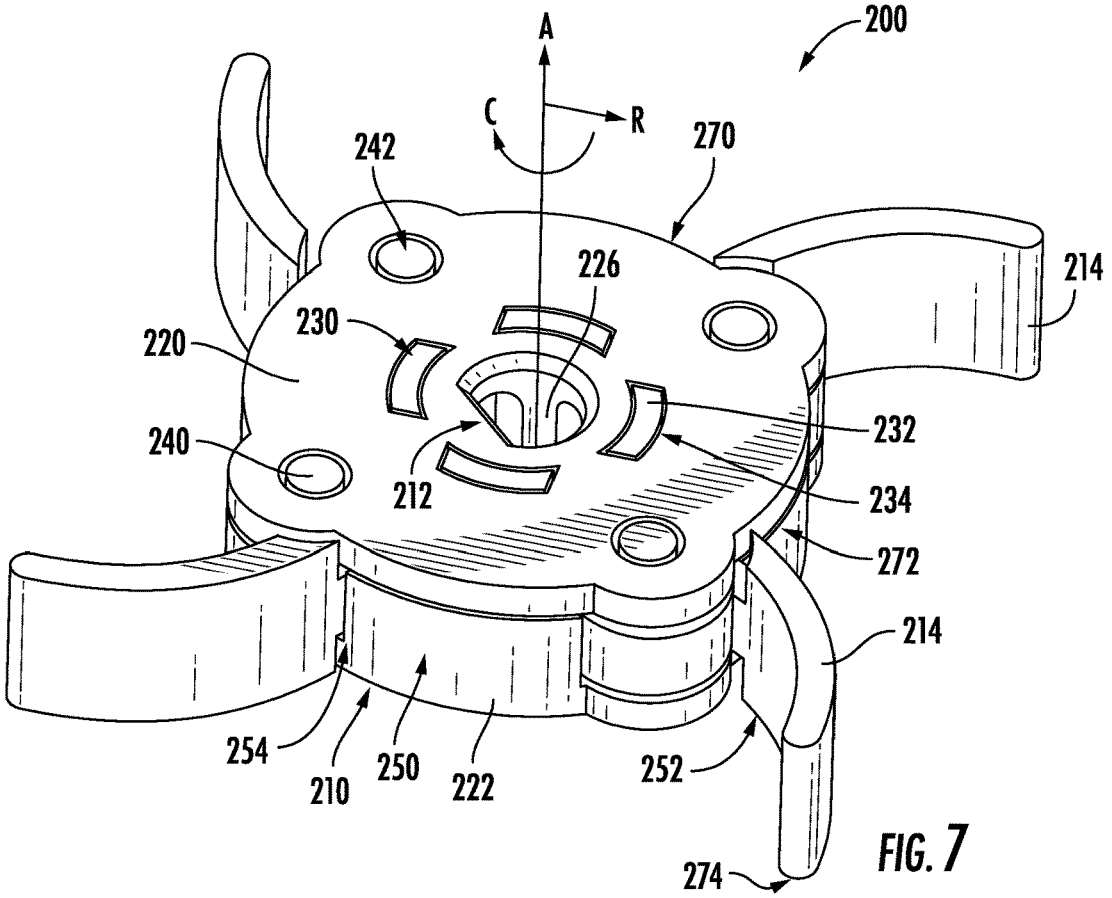
FIG. 7 provides a perspective view of the example drain pump impeller of FIG. 6 in an extended position according to an example embodiment of the present subject matter.
Figure 8:
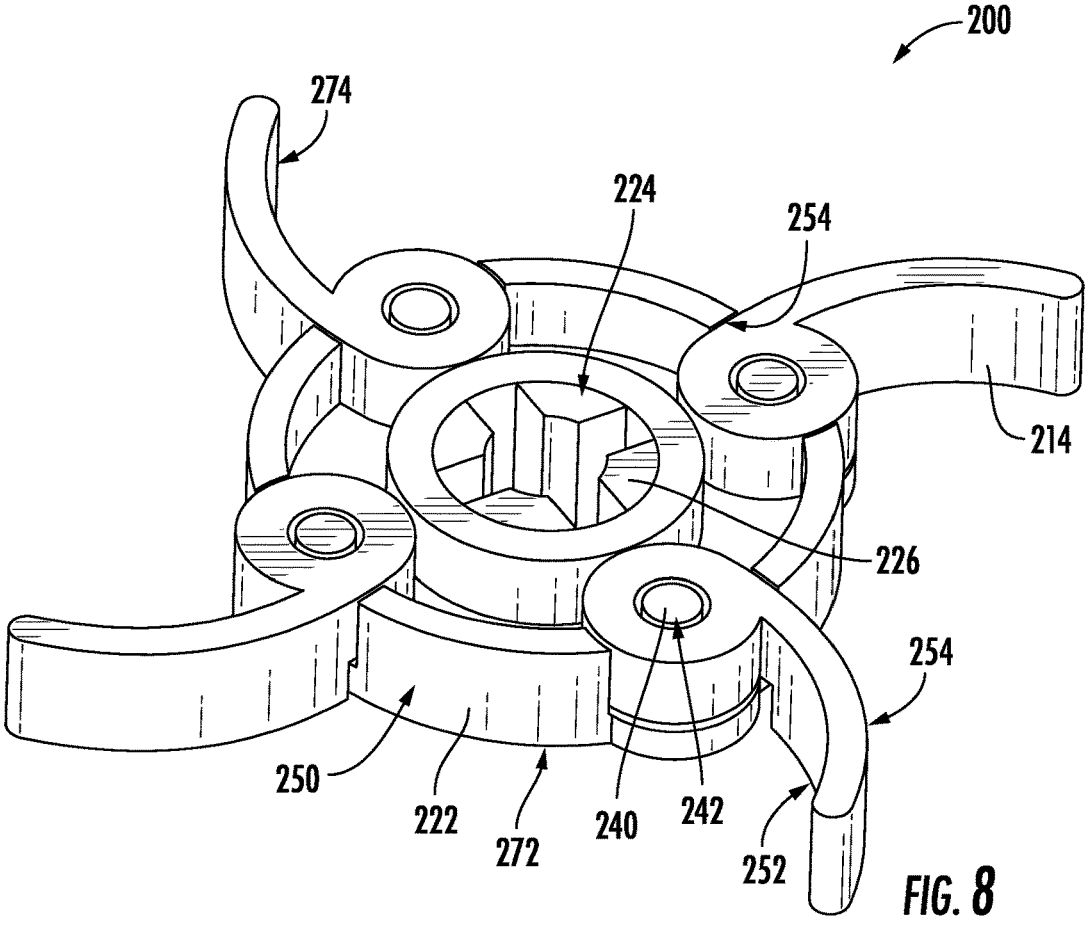
FIG. 8 provides a perspective, cross-sectional view of the example drain pump impeller of FIG. 6 in the extended position according to an example embodiment of the present subject matter.
Figure 9:
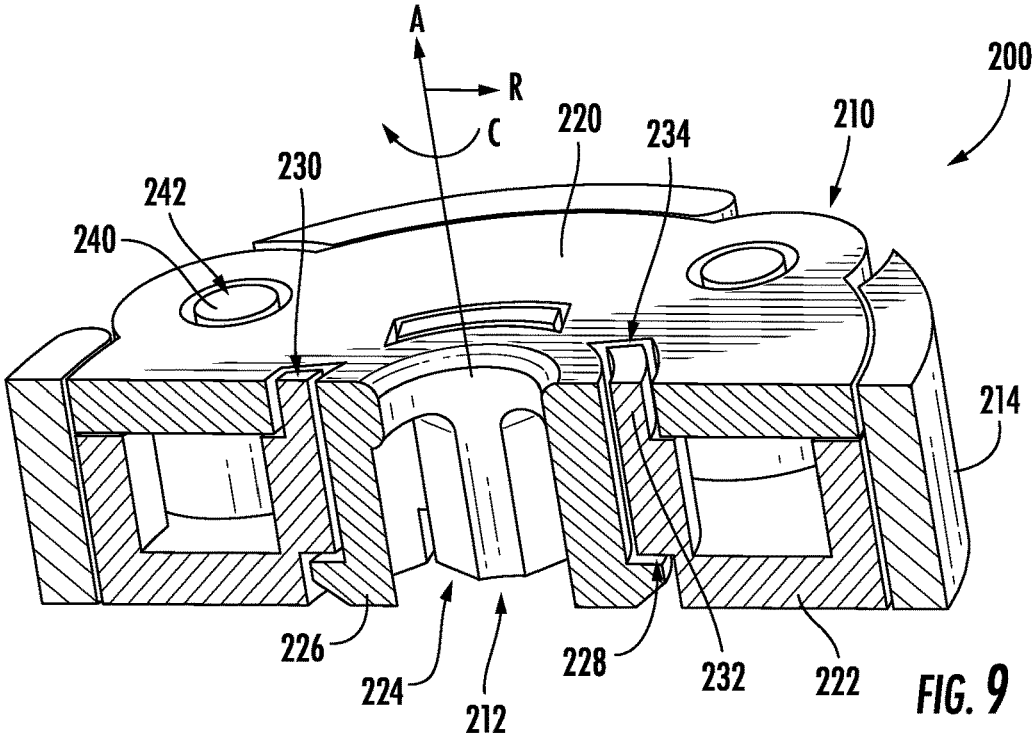
FIG. 9 provides a perspective, cross-sectional view of the example drain pump impeller of FIG. 6 in the retracted position according to an example embodiment of the present subject matter.
Figure 10:
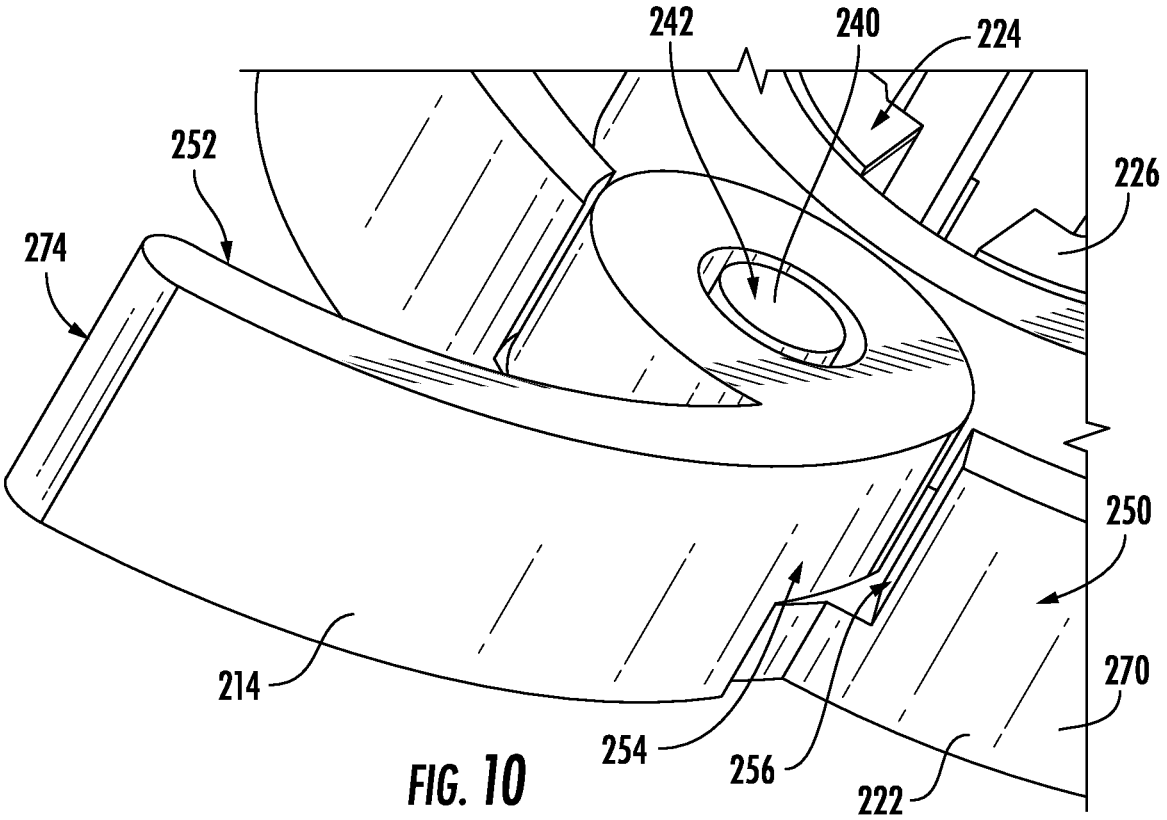
FIG. 10 provides a close-up, cross-sectional view of a vane of the example drain pump impeller of FIG. 6 in the extended position according to an example embodiment of the present subject matter.
Figure 11:
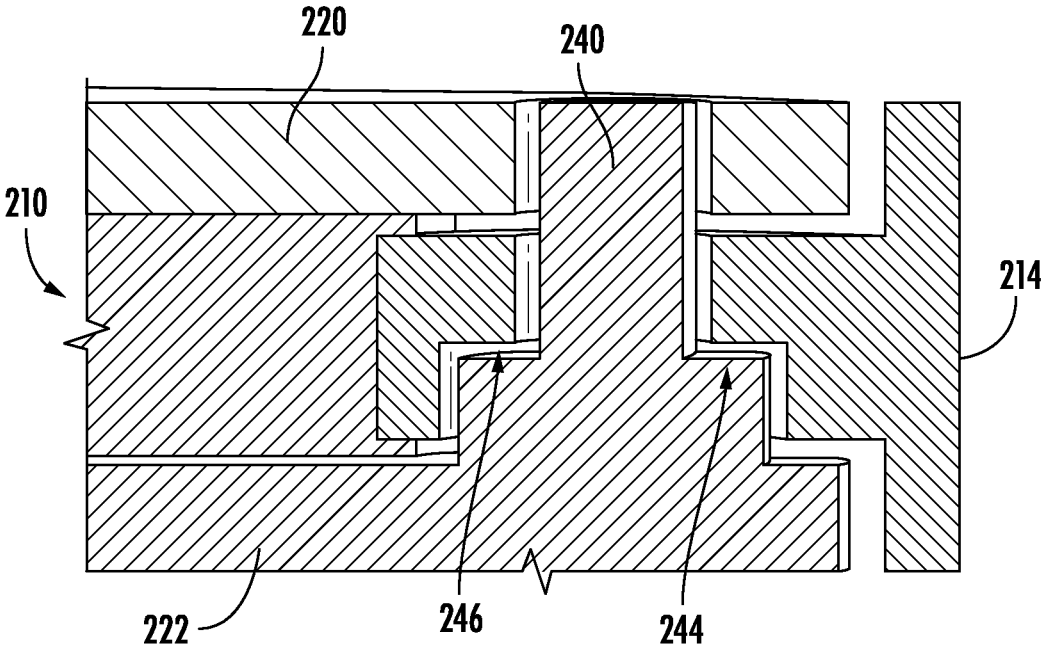
FIG. 11 provides a perspective, cross-sectional view of the example drain pump impeller of FIG. 6 in the retracted position according to an example embodiment of the present subject matter.
Figure 12:
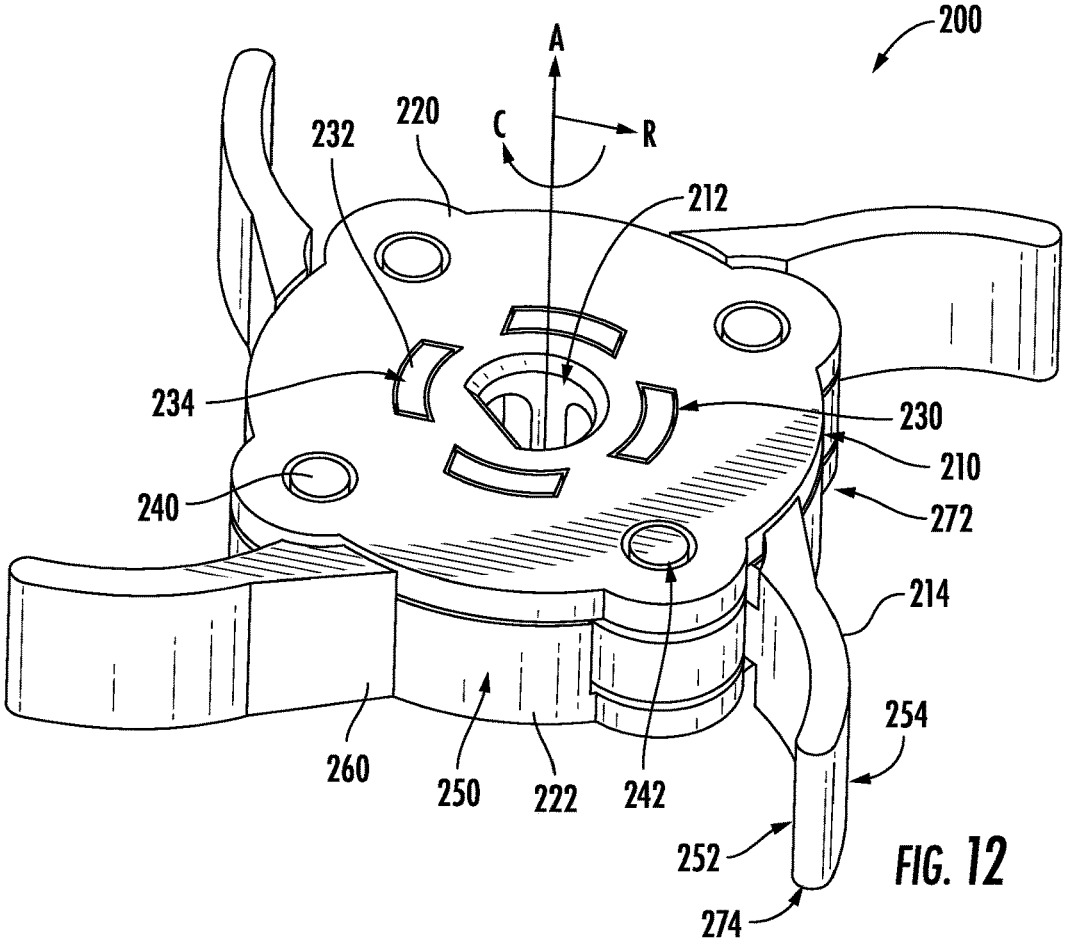
FIG. 12 provides a perspective view of a drain pump impeller that may be used with the example fluid circulation assembly of FIG. 3, where the drain pump impeller is in an extended position according to an example embodiment of the present subject matter.

As best shown in FIGS. 7, 8, and 12, when top portion 220 and bottom portion 222 are properly joined to form hub assembly 210, hub assembly 210 may define a solid perimeter wall 250. In general, solid perimeter wall 250 may prevent soil and fluid from entering into the void spaces between top portion 220 and bottom portion 222. As illustrated, the radius of curvature of each rigid vane 214 may generally match the radius of curvature of solid perimeter wall 250 of hub assembly 210. In addition, each rigid vane 214 may define a seating face 252 that sits flush against solid perimeter wall 250 when rigid vane 214 is in the retracted position. Rigid vanes 214 may also define a blocking face 254 is designed to engage a stopping wall 256 when rigid vane 214 reaches the extended position. In this manner, each rigid vane 214 may be circumferentially wrapped around hub assembly 210 when rigid vane 214 is in the retracted position and may extend substantially along the radial direction R when rigid vane 214 is in the extended position.

Figure 13:
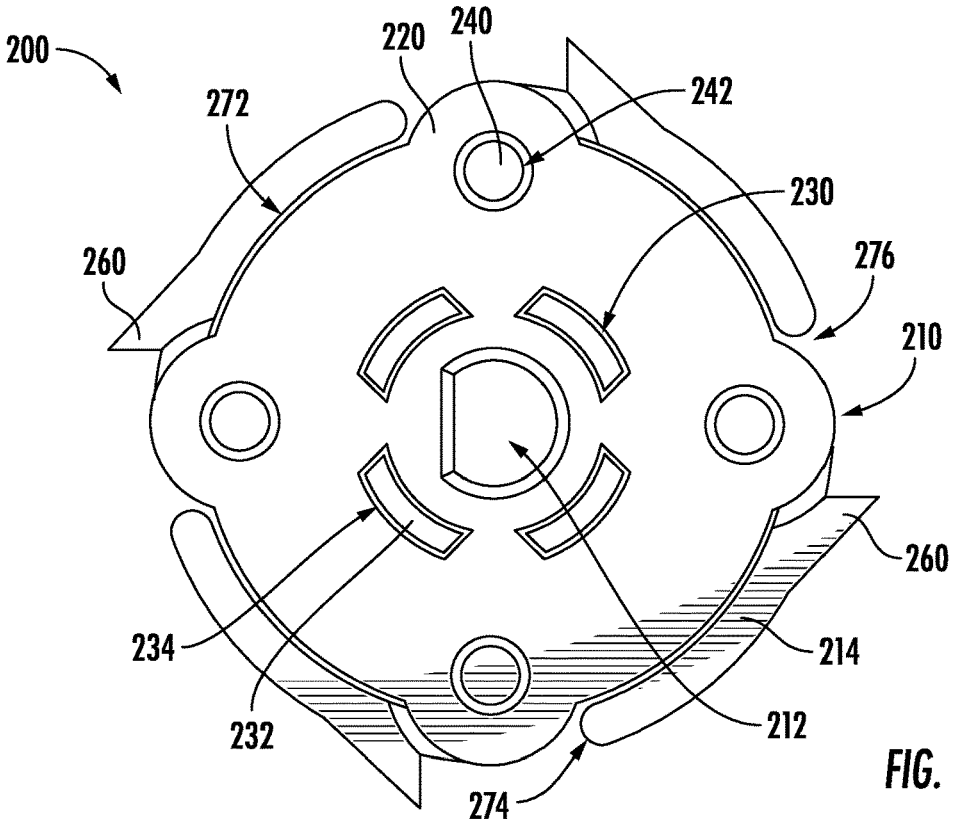
FIG. 13 provides a perspective view of the example drain pump impeller of FIG. 12 in a retracted position according to an example embodiment of the present subject matter.

Referring now briefly to FIGS. 12 and 13, according to an alternative embodiment of the present subject matter, each vane 214 may define a stopping rib 260 on a backside of rigid vane 214 that engages hub assembly 210 when rigid vane 214 reaches the extended position. In this regard, stopping rib 260 may be a protrusion that sticks out from rigid vane 214 has a complimentary profile to hub assembly 210. It should be appreciated that other stopping geometries are possible and within the scope of the present subject matter.

Notably, it may be desirable to have a substantially circular footprint of hub assembly 210 in a horizontal plane (e.g., a plane defined by the lateral direction L and the transverse direction T). Accordingly, the perimeter 270 of hub assembly 210 may generally define a plurality of circumferential recesses 272, each circumferential recess 272 be configured to receive a rigid vane 214 when in the retracted position. In this manner, hub assembly 210 and vanes 214 may create little pressure head when rotating in a direction that causes vanes 214 to move to the retracted position.

As illustrated, each rigid vane 214 may generally extend from pivot point 242 to a distal end 274. According to an example embodiment, when rigid vanes 214 are in the retracted position, a circumferential gap 276 may be defined between distal end 274 and an end of circumferential recess 272 along the circumferential direction C. In this regard, each circumferential recess 272 may be slightly larger than rigid vane 214. In this manner, when hub assembly 210 is rotated in the pumping direction, fluid may pass into circumferential gap 276 and urge rigid vanes 214 toward the extended position.

Notably, the size, shape, and geometry of rigid vanes 214 and hub assembly 210 may be modified to achieve the desired pumping action. For example, according to the illustrated embodiment, a height of each rigid vane 214 may be equal to a height of hub assembly 210. In addition, drain pump assembly 200 may include four rigid vanes 214, each of the four rigid vanes 214 being rotatably mounted in a different circumferential quadrant of hub assembly 210. As illustrated, rigid vanes 214 may cover between about 50% and 99% of hub perimeter 270, between about 70% and 97% of hub perimeter 270, between about 80% and 95% of hub perimeter 270, or about 90% of hub perimeter 270.

Thus, as described above, vanes 214 are generally configured to move between an extended position or orientation and a retracted position or orientation. For example, when drive shaft 176 is rotating in a first direction, e.g., a "drain direction," vanes 214 are in the extended position, as shown in FIGS. 7, 8, 10, and 12. When vanes 214 are extended in this manner, drain pump assembly 200 pumps wash fluid out of discharge conduit 204, thereby emptying the wash fluid and soil from sump 138. More specifically, by rotating drive shaft 176 in the drain direction, the force of the water being moved by each vane 214 causes the vane 214 to rotate such that it extends substantially along the radial direction R. According to the illustrated embodiment, each vane 214 has the same length and extends from hub 210 approximately to the outer circumference of drain pump volute 202.

By contrast, when drive shaft 176 is rotating in a second direction, e.g., a "wash direction," vanes 214 are in the retracted position, as shown in FIGS. 6, 9, 11, and 13. More specifically, by rotating drive shaft 176 and drain pump assembly 200 in the wash direction, the force of water exerted on each vane 214 causes the vanes 214 to move toward the retracted position against hub 210. In this manner each vane 214 has a low profile that generates very little pressure head.

It should be appreciated that drain pump assembly 200 is used only for the purpose of explaining aspects of the present subject matter. Modifications and variations may be made to drain pump assembly 200 while remaining within the scope of the present subject matter. For example, the number, size, spacing, and configuration of vanes 214 may be adjusted while remaining within the scope of the present subject matter. In addition, other embodiments may use more than four vanes having variable lengths, a different hinge configuration may be used, etc.

Drain pump assembly 200 as described above enables both a wash pump impeller and a drain pump impeller of a dishwasher fluid circulation system to be placed on a single drive shaft. In this manner, a single, reversible drive motor can rotate the drive shaft in a first direction for drain cycles and in the opposite direction for wash/rinse cycles. Furthermore, because the vanes of the exemplary drain pump assembly 200 fold up when the drive shaft is rotating in the wash direction, they do not drain the wash fluid from the sump of the dishwasher during a wash/rinse cycle. Moreover, drain pump assembly 200 eliminates the need for complicated valve systems to prevent undesirable draining of the dishwasher and reduces the amount of shaft power necessary to overcome excess drag due to a conventional drain pump impeller.

As explained herein, aspects of the present subject matter are generally directed to a one-way impeller for household appliances, such as a dishwasher. For example, the impeller includes a series of pivoting impeller blades, such that when the impeller assembly is rotating in the pumping direction, the wash fluid to be pumped applies pressure to the impeller blades to force them to the open state via a pivot pin where pumping will begin. A back-stop rib may be used to limit the open position of the impeller blade. Alternatively, when the impeller is rotated in the non-pumping direction, the wash fluid applies pressure to the impeller blades to force them to the closed state, thus significantly reducing or eliminating all pumping action. The momentum of the impeller blades may also contribute to the opening/closing action of the impeller blades.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A fluid circulation assembly defining a vertical direction and comprising:
   a drive shaft defining an axial direction, a radial direction, and a circumferential direction;
   a motor operable to rotate the drive shaft in a first direction and in a second direction opposite the first direction; and
   a drain pump assembly comprising:
      a hub assembly mounted to the drive shaft, wherein the hub assembly defines a maximum outer circumference; and
      a rigid vane rotatably mounted to the hub assembly at a pivot point and extending to a distal end, the rigid vane being unflexible and movable between an extended position when the motor is rotating in the first direction and a retracted position when the motor is rotating in the second direction, wherein the distal end of the rigid vane remains within the maximum outer circumference when the rigid vane is in the retracted position.

2. The fluid circulation assembly of claim 1, wherein a hub perimeter defines a circumferential recess, and wherein the rigid vane is positioned within the circumferential recess in the retracted position.

3. The fluid circulation assembly of claim 2, wherein a circumferential gap is defined between the distal end of the rigid vane and an end of the circumferential recess when the rigid vane is in the retracted position.

4. The fluid circulation assembly of claim 2, wherein the hub perimeter and the rigid vane define a circular footprint when the rigid vane is in the retracted position.

5. The fluid circulation assembly of claim 1, wherein a height of the rigid vane is equal to a height of the hub assembly.

6. The fluid circulation assembly of claim 1, wherein the rigid vane defines a stopping rib on a back side of the rigid vane.

7. The fluid circulation assembly of claim 1, wherein the hub assembly comprises a top portion and a bottom portion that are joined to define a solid perimeter wall.

8. The fluid circulation assembly of claim 7, wherein the top portion and the bottom portion define a snap geometry that engages to form the hub assembly.

9. The fluid circulation assembly of claim 1, wherein the hub assembly defines a mounting pin that passes through the pivot point of the rigid vane to secure the rigid vane to the hub assembly.

10. The fluid circulation assembly of claim 9, wherein the mounting pin defines a shoulder geometry and the rigid vane defines a complementary void to the shoulder geometry to prevent reverse assembly.

11. The fluid circulation assembly of claim 1, wherein a radius of curvature of the rigid vane matches a radius of curvature of the hub assembly.

12. The fluid circulation assembly of claim 1, wherein the drain pump assembly comprises four rigid vanes, each of the four rigid vanes being rotatably mounted in a different circumferential quadrant of the hub assembly.

13. The fluid circulation assembly of claim 12, wherein the hub assembly defines a hub perimeter, and wherein the four rigid vanes cover between 80% and 95% of the hub perimeter.

14. The fluid circulation assembly of claim 1, wherein the rigid vane defines a blocking face and a seating face, wherein the seating face sits flush against the hub assembly when the rigid vane is in the retracted position and the blocking face sits flush against the hub assembly when the rigid vane is in the extended position.

15. The fluid circulation assembly of claim 1, wherein the rigid vane is circumferentially wrapped around the hub assembly when the rigid vane is in the retracted position and extends along the radial direction when the rigid vane is in the extended position.

16. The fluid circulation assembly of claim 1, further comprising:
   a wash pump impeller coupled to the drive shaft; and
   a filter defining an aperture, the drive shaft extending through the aperture, and the wash pump impeller being coupled to the drive shaft above the filter along the vertical direction and the drain pump assembly being coupled to the drive shaft below the filter along the vertical direction.

17. A dishwasher appliance defining a vertical, a lateral, and a transverse direction, the dishwasher appliance comprising:
   a wash tub that defines a wash chamber;
   a wash rack mounted within the wash chamber, the wash rack being configured for receiving articles for washing; and
   a fluid circulation assembly for providing a flow of wash fluid for cleaning articles placed within the wash chamber, the fluid circulation assembly comprising:
      a drive shaft defining an axial direction, a radial direction, and a circumferential direction;
      a motor operable to rotate the drive shaft in a first direction and in a second direction opposite the first direction;
      a hub assembly mounted to the drive shaft, wherein the hub assembly defines a maximum outer circumference; and
      a rigid vane rotatably mounted to the hub assembly at a pivot point and extending to a distal end, the rigid vane being unflexible and movable between an extended position when the motor is rotating in the first direction and a retracted position when the motor is rotating in the second direction, wherein the distal end of the rigid vane remains within the maximum outer circumference when the rigid vane is in the retracted position.

18. The dishwasher appliance of claim 17, wherein a hub perimeter defines a circumferential recess, and wherein the rigid vane is positioned within the circumferential recess in the retracted position, and wherein a circumferential gap is defined between the distal end of the rigid vane and an end of the circumferential recess when the rigid vane is in the retracted position.

19. The dishwasher appliance of claim 17, wherein the hub assembly comprises a top portion and a bottom portion that are joined to define a solid perimeter wall.

20. The dishwasher appliance of claim 17, wherein the fluid circulation assembly comprises four rigid vanes, each of the four rigid vanes being rotatably mounted in a different circumferential quadrant of the hub assembly, and wherein the hub assembly defines a hub perimeter, and wherein the four rigid vanes cover between 80% and 95% of the hub perimeter.

* * * * *